US011293435B2

(12) United States Patent
Dreifert et al.

(10) Patent No.: US 11,293,435 B2
(45) Date of Patent: Apr. 5, 2022

(54) VACUUM PUMP SCREW ROTORS WITH SYMMETRICAL PROFILES ON LOW PITCH SECTIONS

(71) Applicant: Leybold GmbH, Cologne (DE)

(72) Inventors: Thomas Dreifert, Kerpen (DE); Dirk Schiller, Hürth (DE); Wolfgang Giebmanns, Erftstadt (DE); Roland Müller, Cologne (DE)

(73) Assignee: LEYBOLD GMBH, Cologne (DE)

( * ) Notice: Subject to any disclaimer, the term of this patent is extended or adjusted under 35 U.S.C. 154(b) by 194 days.

(21) Appl. No.: 16/326,838

(22) PCT Filed: Aug. 8, 2017

(86) PCT No.: PCT/EP2017/070065
§ 371 (c)(1),
(2) Date: Feb. 20, 2019

(87) PCT Pub. No.: WO2018/041556
PCT Pub. Date: Mar. 8, 2018

(65) Prior Publication Data

US 2019/0211822 A1 Jul. 11, 2019

(30) Foreign Application Priority Data

Aug. 30, 2016 (DE) ..... 10 2016 216 279.9

(51) Int. Cl.
*F01C 1/16* (2006.01)
*F03C 2/00* (2006.01)
(Continued)

(52) U.S. Cl.
CPC ..... *F04C 18/18* (2013.01); *F04C 18/16* (2013.01); *F04C 23/001* (2013.01);
(Continued)

(58) Field of Classification Search
CPC ..... F04C 18/16; F04C 18/18; F04C 23/001; F04C 2230/10; F04C 2230/602;
(Continued)

(56) References Cited

U.S. PATENT DOCUMENTS 2,622,787 A * 12/1952 Hans ..... F04C 18/16 418/201.3
3,265,292 A * 8/1966 Lauritz ..... F04C 23/001 418/9

(Continued)

FOREIGN PATENT DOCUMENTS

CN 1585860 A 2/2005
CN 201368025 12/2009

(Continued)

OTHER PUBLICATIONS

International Search Report dated Nov. 23, 2017 for PCT application No. PCT/EP2017/070566.

(Continued)

*Primary Examiner* — Theresa Trieu
(74) *Attorney, Agent, or Firm* — Ohlandt, Greeley, Ruggiero and Perle, LLP

(57) ABSTRACT

A vacuum pump screw rotor, comprising at least two helical displacer elements on a rotor shaft. The at least two displacer elements have different pitches, but the pitches of each displacer element are constant. Furthermore, the displacer elements each have a helical recess, each having a contour that remains the same over its entire length. Hereby, a suction-side displacer element has a recess having an asymmetric contour, and a pressure-side displacer element has a recess having a symmetrical contour.

17 Claims, 2 Drawing Sheets

(51) Int. Cl.

| | |
|---|---|
| ***F03C 4/00*** | (2006.01) |
| ***F04C 2/00*** | (2006.01) |
| ***F04C 18/00*** | (2006.01) |
| ***F04C 18/18*** | (2006.01) |
| ***F04C 18/16*** | (2006.01) |
| *F04C 23/00* | (2006.01) |

(52) U.S. Cl.
CPC ..... *F04C 2230/10* (2013.01); *F04C 2240/20* (2013.01); *F04C 2250/20* (2013.01); *F05C 2201/021* (2013.01); *F05C 2201/903* (2013.01)

(58) Field of Classification Search
CPC ..... F04C 2230/91; F04C 2240/20; F04C 2240/30; F04C 2250/20; F05C 2201/021; F05C 2201/903
See application file for complete search history.

(56) References Cited

U.S. PATENT DOCUMENTS

| | | | | |
|---|---|---|---|---|
| 6,132,103 | A | 10/2000 | Englund | |
| 6,341,951 | B1 * | 1/2002 | Chen | F04C 23/001 418/9 |
| 6,544,020 | B1 * | 4/2003 | Bahnen | F04C 18/16 418/201.1 |
| 6,758,660 | B2 | 7/2004 | Kriehn et al. | |
| 6,918,749 | B2 | 7/2005 | Garczorz et al. | |
| 7,056,108 | B2 | 6/2006 | Behling et al. | |
| 2003/0152475 | A1 * | 8/2003 | Becher | F04C 18/16 418/201.1 |
| 2005/0236437 | A1 * | 10/2005 | Miyashita | F04C 18/16 418/201.3 |
| 2008/0025858 | A1 * | 1/2008 | Hwang | F04C 23/001 418/9 |
| 2008/0044304 | A1 * | 2/2008 | Izawa | F04C 23/001 418/9 |
| 2008/0240967 | A1 * | 10/2008 | Goepfert | F04C 18/16 418/201.3 |
| 2010/0086883 | A1 | 4/2010 | Zollig et al. | |
| 2010/0150760 | A1 * | 6/2010 | Yamamoto | F04C 23/001 418/9 |
| 2013/0183185 | A1 | 7/2013 | Dirscherl et al. | |

FOREIGN PATENT DOCUMENTS

| | | | | |
|---|---|---|---|---|
| CN | 102974990 | A | 3/2013 | |
| DE | 10129341 | A1 | 1/2003 | |
| DE | 69721031 | T2 | 2/2004 | |
| DE | 102010019402 | A1 | 11/2011 | |
| DE | 102011118050 | A1 | 5/2013 | |
| EP | 1070878 | A2 | 1/2001 | |
| EP | 1242743 | A1 | 9/2002 | |
| EP | 1305524 | A1 | 5/2003 | |
| EP | 1882856 | A1 | 1/2008 | |
| EP | 1890039 | A2 | 2/2008 | |
| EP | 2196675 | A2 | 6/2010 | |
| EP | 2615307 | A1 | 7/2013 | |
| GB | 2030227 | A | 4/1980 | |
| JP | 2000045976 | A * | 2/2000 | F04C 18/16 |
| JP | 2015183572 | A | 10/2015 | |
| KR | 20030026992 | A | 4/2003 | |
| KR | 20050010753 | A | 1/2005 | |
| KR | 20070022575 | A | 2/2007 | |
| WO | 2003042541 | A1 | 5/2003 | |
| WO | 2005038255 | A2 | 4/2005 | |

OTHER PUBLICATIONS

Dadapan ,S.; "Vacuum Design Handbook, 3rd Edition"; Defence Workers Industriepresse; Jul. 2004; pp. 1-8 (with English translation).

* cited by examiner

VACUUM PUMP SCREW ROTORS WITH SYMMETRICAL PROFILES ON LOW PITCH SECTIONS

BACKGROUND

1. Field of the Disclosure

The disclosure relates to a vacuum pump screw rotor.

2. Discussion of the Background Art

Screw vacuum pumps comprise two rotor elements arranged within a pumping chamber formed by a housing. The rotor elements have a helical contour and, for conveyance of gases, are rotated in opposite senses. For achieving a high inner condensation, i.e. a volume ratio between the inlet and the outlet of the pump, it is known that the helical contour has a varying pitch. On the inlet side or suction side, the pitch is large, and also the volume of the chambers formed per winding is large. In the direction of the outlet, the pitch decreases so that, on the outlet or pressure side, there exist a small pitch and also small chamber volumes per winding. By providing a varying pitch, it is possible to realize a low power input with low inlet pressures and, at the same time, a low thermal stress of the pump. The provision of a varying pitch requires a complex and thus expensive manufacturing process. Particularly, the manufacturing stages such as the milling or lathing of the windings, i.e. of the helical recesses, have to be performed in several successive working steps.

It is an object of the disclosure to provide a vacuum pump screw rotor wherein the pump, having low power input and undergoing low thermal stress, can be manufactured in an inexpensive manner. Further, it is an object of the disclosure to provide a corresponding screw vacuum pump and a suitable manufacturing method.

SUMMARY

The vacuum pump screw rotor of the disclosure comprises at least two helical displacer elements arranged on a rotor shaft. By the displacer elements, the rotor element is formed. According to the disclosure, the at least two displacer elements have different pitches, wherein, for each displacer element, the pitch is constant. The vacuum pump screw rotor of the disclosure comprises e.g. two displacer elements, wherein a first, suction-side displacer element has a larger constant pitch and a second, pressure-side displacer element has a smaller constant pitch. By the provision, in accordance with the disclosure, of a plurality of displacer elements which each have a constant pitch, the manufacturing process is considerably simplified.

According to the disclosure, each displacer element comprises at least one helical recess which has the same contour along its entire length. Preferably, the contours are different for each displacer element. Thus, a respective displacer element preferably comprises a constant pitch and a uniform contour. As a result, manufacture is considerably facilitated so that the production costs can be massively lowered.

For further improvement of the suction capacity, the contour of the suction-side displacer element, i.e. particularly the first displacer element as viewed in the pumping direction, is asymmetric. By the asymmetric shape of the contour or profile, the flanks can be designed in such a manner that the leakage surfaces, the so-called blowholes, are preferably entirely eliminated or at least have a smaller cross section. A particularly useful asymmetric profile is the so-called "Quimby profile". Even though such a profile is relatively difficult to manufacture, it has the advantage that there is no continuous blowhole. A short circuit exists only between two adjacent chambers. Since the profile is an asymmetric profile having different profile flanks, manufacture thereof requires at least two working steps because the two flanks, due to their asymmetry, have to be produced in two different working steps.

The pressure-side displacer element, particularly the last displacer element as viewed in the pumping direction, is provided with a symmetric contour. The symmetric contour particularly has the advantage that the manufacture will be simpler. Particularly, both flanks with symmetric contour can be generated in one working step by use of a rotating end mill or a rotating side milling cutter. Symmetric profiles of this type comprise only small blowholes, but these are provided continuously, i.e. are not only provided between two adjacent chambers. The size of the blowhole decreases with decreasing pitch. Accordingly, such symmetric profiles can be provided particularly for the pressure-side displacer element since these, according to a preferred embodiment, have a smaller pitch than the suction-side displacer element and preferably also than the displacer element arranged between the suction-side displacer element and the pressure-side displacer element. Even though the leak-tightness of such symmetric profiles is somewhat lower, these have the advantage that their manufacture is distinctly simpler. Particularly, it is rendered possible to generate the symmetric profile in a single working step by use of a simple end mill or side milling cutter. Thereby, the costs are considerably reduced. A particularly useful symmetric profile is the so-called "cycloidal profile".

The provision of at least two such displacer elements makes it possible that the corresponding screw vacuum pump can generate low inlet pressures while the power input is low. Further, the thermal stress is low. The arranging of at least two displacer elements designed according to the disclosure, having a constant pitch and a uniform contour, in a vacuum pump will substantially lead to the same results as in a vacuum pump having a displacer element with varying pitch. In case of high specified volume ratios, three or four displacer elements can be provided, depending on the rotor.

For reducing the achievable inlet pressure and/or for reducing the power input and/or the thermal stress, it is provided according to a particularly preferred embodiment that a pressure-side displacer element, i.e. the last displacer elements as viewed in the pumping direction, comprises a large number of windings. Due to the large number of windings, there can be accepted a larger gap between the screw rotor and the housing, while the performance will remain the same. The gap herein can have a cold gap width in the range from 0.1-0.3 mm. A large number of outlet windings and respectively of windings in the pressure-side displacer element is inexpensive in production since, according to the disclosure, this displacer element has a constant pitch and particularly also a symmetric contour. This allows for a simple and inexpensive production process so that the provision of a larger number of windings is acceptable. Preferably, this pressure side displacer element or last displacer element comprises more than 8, particularly more than 10 and with particular preference more than 12 windings. The use of symmetric profiles has the advantage, in a particularly preferred embodiment, that, by use of a milling cutter, both flanks of the profile can be cut simultaneously. In this process, the milling cutter is additionally supported by the respective opposite flank, thus avoiding deformation or deflection of the milling cutter during and resulting inaccuracies.

For further reduction of the manufacturing costs, it is particularly preferred that the displacer elements and the rotor shaft are formed as one piece.

According to a further preferred embodiment, the change of pitch between adjacent displacer elements is provided in a non-uniform or abrupt manner. Optionally, the two displacer elements are arranged at a distance from each other in the longitudinal direction so that, between two displacer elements, a surrounding cylindrical chamber is formed which serves as a tool run-out zone. This is advantageous particularly in rotors of a one-pieced configuration because, in this region, the tool generating the helical line can be withdrawn in a simple manner. In case that the displacer elements are manufactured independently from each other and then are mounted on a shaft, provision of a tool run-out zone, particularly of such a ring-shaped cylindrical region, will not be necessary.

According to a preferred embodiment of the disclosure, no tool run-out zone is provided between two adjacent displacer elements at the pitch change. In the region of the pitch change, preferably both flanks comprise a void or recess so as to allow the tool to be withdrawn. Such a void has no noteworthy influence on the compression performance of the pump because the void or recess is local and quite limited in size.

The vacuum pump screw rotor of the disclosure particularly comprises a plural number of displacer elements. These can each time have the same diameter or different diameters. In this respect, it is preferred that the pressure-side displacer element has a smaller diameter than the suction-side displacer element.

In case of displacer elements produced independently from the rotor shaft, the displacer elements will be mounted on the shaft e.g. by press fitting. Herein, it is preferred to provide elements such as dowel pins for fixation of the angular position of the displacer elements relative to each other.

Particularly in case of a one-pieced design of the screw rotor but also in case of a multi-pieced design, it is preferred to produce the screw rotor from aluminum or an aluminum alloy. It is particularly preferred to produce the rotor from aluminum or an aluminum alloy, particularly from AlSi7Mg or AlSi17Cu4Mg. The alloy preferably has a silicon percentage of more than 15% so as to reduce the expansion coefficient.

According to a further preferred embodiment of the disclosure, the aluminum used has a lower expansion coefficient. It is preferred that the material has an expansion coefficient of less than $18*10^{-6}$/K. According to a further preferred embodiment, the surface of the displacer elements is coated, there being provided particularly a coating against wear and/or corrosion. Herein, there is provided with preference an anodic coating or another suitable coating, depending on the field of application.

The disclosure further relates to a screw vacuum pump. This pump comprises two mutually meshing vacuum-pump screw rotors as described above. The two screw rotors are arranged in a suction chamber formed by a pump housing. Normally, one of the two screw rotors is connected to a drive means such as e.g. an electric motor. The two screw rotors can be connected to each other via toothed wheels which particularly are arranged on the rotor shafts. This way, there is particularly effected a synchronization of the screw rotors rotating in opposite senses. According to a particularly preferred embodiment, it is possible, due to the inventive design of the screw rotors, to achieve an internal compression of the screw vacuum pump is at least two, particularly at least four. Such a high internal compression is possible especially due to the design of the two rotors with respective constant pitch and particularly with high numbers of windings of the pressure-side displacer element. Particularly, this is possible although large gaps are allowed in the region of the pressure-side displacer element. The large gaps particularly have the advantage that the thermal stress will be distributed more evenly across the pressure-side displacer element. Particularly, there will also be avoided the thermal stress of the corresponding displacer element and thus the danger of the displacer element being contacted on the inner side of the housing. A further aspect in this regard resides in that the screw rotors have a lower expansion coefficient than the housing. Particularly, the expansion coefficient of the housing is at least 5% and with particular preference 10% larger than that of the screw rotors.

It is preferred herein that the housing is produced from an aluminum alloy having a smaller percentage of silicon than the percentage of silicon in the material of the screw rotors. This ensures a larger thermal expansion of the housing relative to the screw rotors. Thereby, it is ensured particularly that in operation, i.e. with increasing thermal stress, even though the gap can become smaller, there will always be a sufficient gap between the outer side of the displacer elements and the inner side of the pumping chamber.

The disclosure further relates to a method for producing a screw rotor as described above. The manufacture herein is performed particularly in such a manner that the displacer elements and the rotor shaft are formed in one piece. In a first step, a base body for the screw rotor will be produced. The helical recesses for producing the displacer element are generated by means of an end mill or a side milling cutter. Depending on the displacer element, this is performed in a separate step because the pitch and particularly the contour of the helical recesses are different in each displacer element.

It is preferred that, in case of displacer elements with symmetric contour, the recess is generated by use of a single tool and particularly in a single working step. Further, it is preferred that the tool reproduces the outer contour of the recess so that, preferably, both flanks can be generated in one working step.

In case of an asymmetric element, the flanks have to be processed by two different tools.

It is preferred that, particularly in screw rotors produced as one piece, a tool run-out zone will be generated prior to the generating of the helical recesses. Such a ring-shaped cylindrical recess can be produced by milling or lathing.

According to a particularly preferred embodiment, no such tool run-out zone is provided. Instead, a recess or void is provided in a flank of an adjacent displacer element. In this case, the void or recess will be generated when the milling tool is withdrawn.

The base body used is particularly designed in a cylindrical shape so that, from a single base body, there can be produced the rotor shaft, optionally together with shaft journals following the shaft, and particularly also the displacer elements. It is also possible to use a base body which is formed as a semi-finished product and already comprises recesses and/or bearing pins. The base body can be produced e.g. by a casting process.

The disclosure will be explained in greater detail hereunder by way of a preferred embodiment and with reference to the accompanying drawings.

BRIEF DESCRIPTION OF THE DRAWINGS

The following is shown.

DETAILED DESCRIPTION OF THE PREFERRED EMBODIMENT

Figure 1:
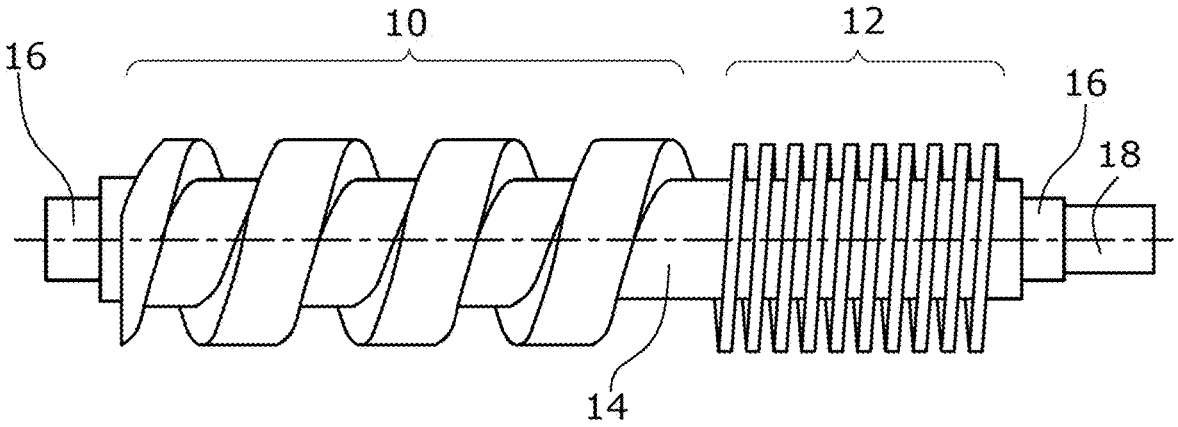
FIG. 1 shows a schematic plan view of a first preferred embodiment of a vacuum pump screw rotor.

According to the first preferred embodiment of the vacuum pump screw rotor, the rotor comprises two displacer elements 10, 12. A first, suction-side displacer element 10 has a large pitch of about 10-150 mm/revolution. The pitch is constant along the entire displacer element 10. Also the contour of the helical recess is constant. The second, pressure-side displacer element 12 again has, along its length, a constant pitch and a constant contour of the recess. The pitch of the pressure-side displacer element 12 is preferably in the range of 10-30 mm/revolution. Between the two displacer elements, a ring-shaped cylindrical recess or void 14 is provided. Said recess has the purpose of realizing a tool run-out zone in view of the one-pieced design of the screw rotor shown in FIG. 1.

Further, the one-pieced screw rotor comprises two bearing seats 16 and shaft end 18. To the shaft end 18, there is connected e.g. a toothed wheel for driving.

Figure 2:
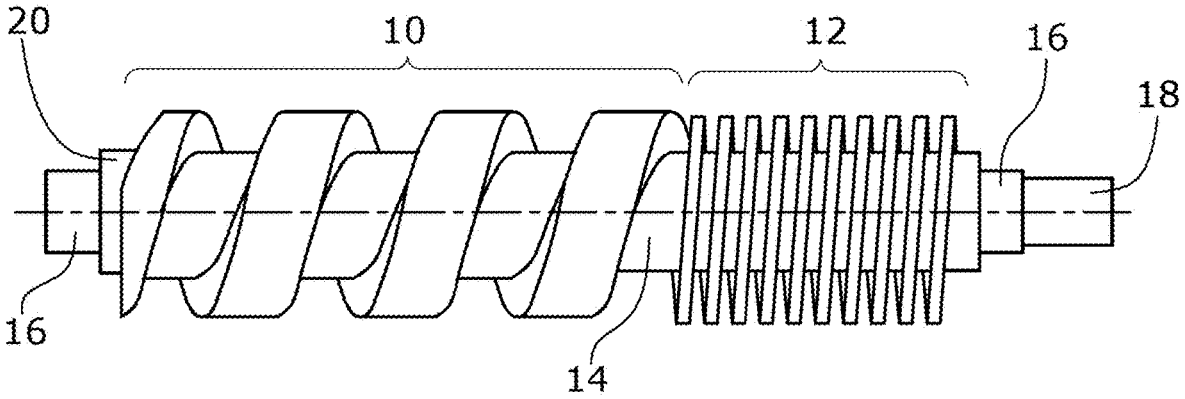
FIG. 2 shows a schematic plan view of a second preferred embodiment of a vacuum pump screw rotor.

In the second preferred embodiment shown in FIG. 2, the two displacer elements 10, 12 are produced separately and will then be fixed on a rotor shaft 20 e.g. by pressing them on. This production method may be somewhat more complex but there is obviated the need for the cylindrical distance 14 between two adjacent displacer elements 10, 12 for tool run-out. The bearing seats 16 and the shaft ends 18 can be integral components of the displacer elements. Alternatively, a continuous shaft 20 can also be produced from another material that is different from the displacer elements 10, 12.

Figure 3:
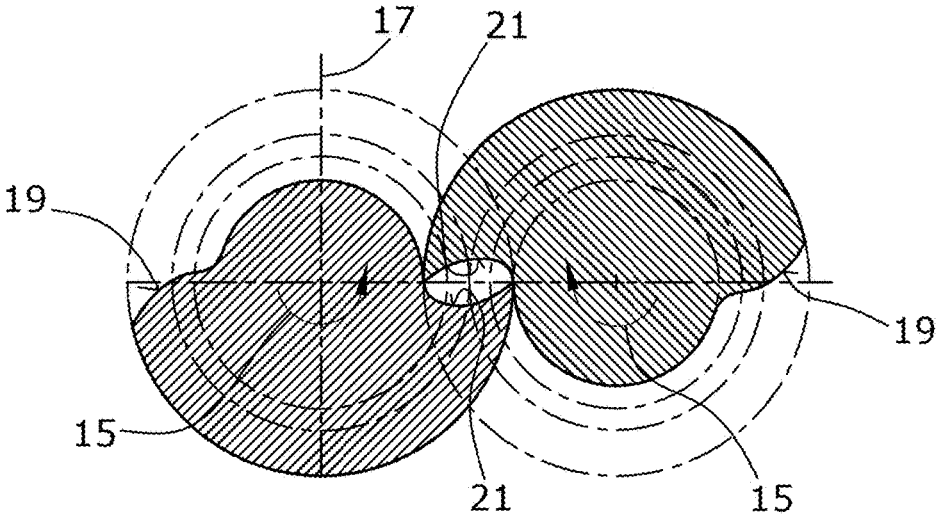
FIG. 3 shows a schematic sectional view of displacer elements with asymmetric profile.

FIG. 3 shows a schematic lateral view of an asymmetric profile (e.g. a Quimby profile). The asymmetric profile shown is a so-called "Quimby profile". The sectional view shows two screw rotors which mesh with each other and whose longitudinal direction extends vertically to the plane of the drawing. The rotation of the rotors in opposite senses in indicated by the two arrows 15. With respect to a plane 17 extending vertically to the longitudinal axis of the displacer elements, the profiles of the two flanks 19 and 21 are different in each rotor. Thus, the mutually opposite flanks 19, 21 have to be produced independently from each other. However, in the manufacture which for this reason is somewhat more complex and difficult, an advantage resides in that there does not exist a throughgoing blowhole but only a short circuit between two adjacent chambers.

Such a symmetric profile is preferably provided in the suction-side displacer element 10.

Figure 4:
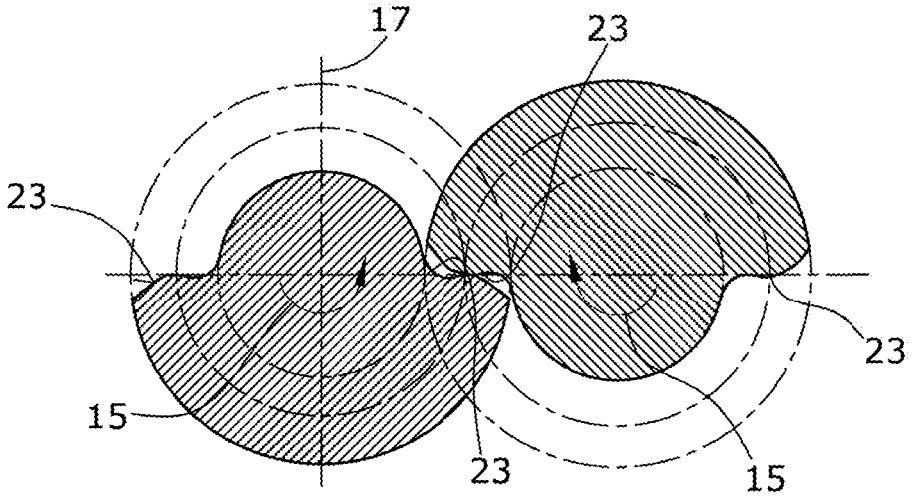
FIG. 4 shows a schematic sectional view of displacer elements with symmetric profile.

The schematic lateral view in FIG. 4, in turn, shows a sectional view of two displacer elements and respectively two screw rotors which again rotate in opposite senses (arrows 15). With respect to the axis of symmetry 17, the flanks 23 have a symmetric design in each displacer element. In the preferred embodiment of a symmetrically designed contour shown in FIG. 4, a cycloidal profile is used.

A symmetric profile as shown in FIG. 4 is preferably provided in the pressure-side displacer elements 12.

The further embodiment, shown in FIG. 5, is again of a one-pieced design. For withdrawal of the tool, such as e.g. an end mill, the flank of the displacer element 12 is provided with a recess or void.

Further, it is possible to provide more than two displacer elements. These can optionally have different head diameters and corresponding foot diameters. Herein, it is preferred that a displacer element with larger head diameter is arranged at the inlet, i.e. on the suction side, so as to realize a larger suctional capacity in this region and/or to increase the volume ratio. Also combinations of the above described embodiments are possible. For instance, two or more displacer elements can be produced in one piece with the shaft, or an additional displacer element can be produced independently from the shaft and then be mounted on the shaft.

A schematic sectional view of a vacuum pump (FIG. 5) shows, within a housing 22, two vacuum pump screw rotors 26 arranged in a pumping chamber 24. The two rotors are supported in the housing 22 via bearings 28 with a gap 30 defined between the housing 22 and the second, pressure-side displacer element 12. The gap 30 has a height in a range of 0.05 mm to 0.5 mm. Connected to two shaft ends 18 are respective toothed wheels 32. The latter mesh with each other, thus ensuring a synchronization of the two shafts. One of the two toothed wheels 32 is coupled to a drive means such as e.g. an electric motor.

Figure 5:
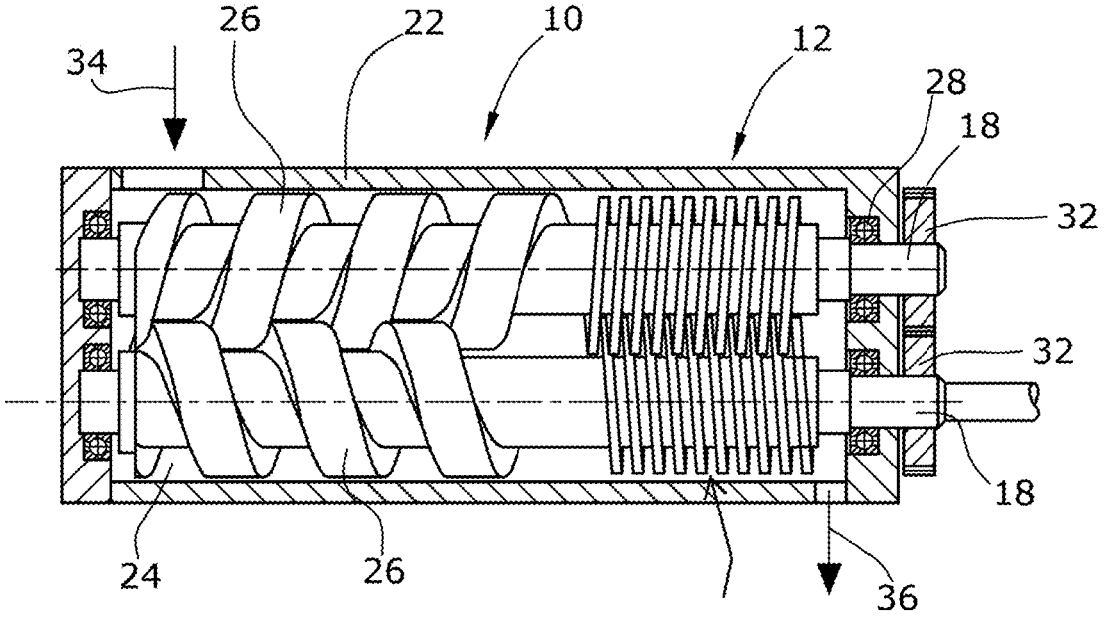
FIG. 5 shows a schematic sectional view of a screw vacuum pump.

As can be seen in FIG. 5, the suctional intake of the gas occurs in the region of the suction-side displacer elements 10, as indicated by arrow 34. Discharge of the gas occurs, correspondingly, at the end of the second, pressure-side displacer element 12, as indicated by arrow 36.

The invention claimed is:

1. A vacuum pump screw rotor, comprising:

at least two helical displacer elements arranged on a rotor shaft, wherein the at least two displacer elements have pitches differing from each other but being constant for each displacer element, and wherein the at least two displacer elements each comprise at least one helical recess, each recess having a uniform contour over its entire length, wherein a suction-side displacer element has an asymmetric contour, and wherein a pressure-side displacer element has a symmetric contour.

2. The vacuum pump screw rotor according to claim 1, wherein at least two rotor elements comprising respective helical displacer elements are provided, wherein the displacer elements have pitches differing from each other but being constant for each displacer element.

3. The vacuum pump screw rotor according to claim 1, wherein the pressure-side displacer element comprises more than 8 windings.

4. The vacuum pump screw rotor according to claim 1, wherein the pressure-side displacer element is of the single-threaded type.

5. The vacuum pump screw rotor according to claim 1, wherein the rotor shaft and the at least two displacer elements are of a one-pieced design.

6. The vacuum pump screw rotor according to claim 1, wherein at least one change of pitch between two adjacent displacer elements is non-uniform.

7. The vacuum pump screw rotor according to claim 1, wherein a profile of the suction-side displacer element is free of blowholes at least on one flank.

8. The vacuum pump screw rotor according to claim 1, wherein, between the at least two displacer elements, a tool run-out zone is provided at the change of pitch.

9. The vacuum pump screw rotor according to claim 1, wherein the entire vacuum pump screw rotor is made of aluminum or an aluminum alloy.

10. The vacuum pump screw rotor according to claim 9, wherein the aluminum or aluminum alloy has an expansion coefficient of less than 18*10-6/K, and has a silicon percentage of at least 15%.

11. A screw vacuum pump, comprising:

two vacuum pump screw rotors according to claim 1 that are mutually meshing, a housing enclosing the two vacuum pump screw rotors, and a drive means connected to the two vacuum pump screw rotors.

12. The screw vacuum pump according to claim 11, comprising an internal compression of at least 2.

13. The screw vacuum pump according to claim 11, wherein the two vacuum pump screw rotors have a lower expansion coefficient than the housing, wherein the expansion coefficient of the housing is 5% larger than that of the screw rotors.

14. The screw vacuum pump according to claim 11, wherein the housing is made of aluminum or an aluminum alloy.

15. The screw vacuum pump according to claim 11, wherein, between the pressure-side displacer elements and the housing, a gap is arranged, said gap having a height in the range of 0.05 mm to 0.5 mm.

16. The vacuum pump screw rotor according to claim 1, wherein, between the at least two displacer elements, a void is provided at a change of pitch in at least one of flank of the at least two displacer elements.

17. A vacuum pump screw rotor, comprising:

a rotor shaft;

a suction-side displacer element arranged on the rotor shaft, wherein the suction-side displacer element has an asymmetric contour and has a first helical recess with a uniform contour over an entire length of the suction-side displacer element, and wherein the suction-side displacer element has an asymmetric contour;

a pressure-side displacer element arranged on the rotor shaft, wherein the pressure-side displacer element has a symmetric contour and has a second helical recess with a uniform contour over an entire length of the pressure-side displacer element, and wherein the pressure-side displacer element has a symmetric contour, wherein the suction-side displacer element and the pressure-side displacer element have constant pitches that differ from each other; and a ring-shaped cylindrical recess between the suction-side displacer element and the pressure-side displacer element, wherein the ring-shaped cylindrical recess is sized and configured as a tool run-out zone.

* * * * *